US007727036B1

(12) United States Patent
Poorman et al.

(10) Patent No.: US 7,727,036 B1
(45) Date of Patent: Jun. 1, 2010

(54) SYSTEM AND METHOD FOR CONTROLLING MOVEMENT OF A MARINE VESSEL

(75) Inventors: Richard N. Poorman, Nineveh, IN (US); Jeffrey W. Rinker, Trafalgar, IN (US)

(73) Assignee: Brunswick Corporation, Lake Forest, IL (US)

( * ) Notice: Subject to any disclaimer, the term of this patent is extended or adjusted under 35 U.S.C. 154(b) by 228 days.

(21) Appl. No.: 11/965,605

(22) Filed: Dec. 27, 2007

(51) Int. Cl.
*B63H 21/22* (2006.01)

(52) U.S. Cl. ..... 440/1

(58) Field of Classification Search ..... 440/1
See application file for complete search history.

(56) References Cited

U.S. PATENT DOCUMENTS

| | | | | |
|---|---|---|---|---|
| 3,521,589 | A | 7/1970 | Kemp | |
| 4,220,111 | A | 9/1980 | Krautkremer et al. | |
| 4,691,659 | A | 9/1987 | Ito et al. | |
| 4,947,782 | A | 8/1990 | Takahashi | |
| 5,090,929 | A | 2/1992 | Rieben | |
| 5,924,379 | A | 7/1999 | Masini et al. | |
| 6,142,841 | A | 11/2000 | Alexander, Jr. et al. | |
| 6,234,853 | B1 | 5/2001 | Lanyi et al. | |
| 6,276,977 | B1 | 8/2001 | Treinen et al. | |
| 6,447,349 | B1 | 9/2002 | Fadeley et al. | |
| 6,684,803 | B1 | 2/2004 | Dickson | |
| 6,713,829 | B1 * | 3/2004 | Karpman | 257/415 |
| 6,755,703 | B1 | 6/2004 | Erickson | |
| 6,896,563 | B1 | 5/2005 | Dickson | |
| 6,994,046 | B2 | 2/2006 | Kaji et al. | |
| RE39,032 | E | 3/2006 | Gonring et al. | |
| 7,186,155 | B2 | 3/2007 | Nickerson | |
| 2007/0089654 | A1 | 4/2007 | Bradley et al. | |
| 2007/0089660 | A1 | 4/2007 | Bradley et al. | |

* cited by examiner

*Primary Examiner*—Stephen Avila
(74) *Attorney, Agent, or Firm*—Andrus, Sceales, Starke & Sawall, LLP

(57) ABSTRACT

A system and method are provided for controlling movement of a marine vessel. An operator controllable device outputs a signal that is representative of an operator-desired rate of position change of the vessel about or along an axis. A sensor outputs a signal that is representative of a sensed actual rate of position change of the vessel about or along the axis. A rate of position change controller outputs a rate of position change command based upon the difference between the desired rate of position change and the sensed rate of position change. A vessel coordination controller controls movement of the vessel based upon the rate of position change command.

17 Claims, 4 Drawing Sheets

SYSTEM AND METHOD FOR CONTROLLING MOVEMENT OF A MARINE VESSEL

BACKGROUND AND SUMMARY

The present application relates generally to movement and coordination control of a marine vessel and, more particularly to improved systems and methods for damping unwanted motions of the marine vessel about or along an axis.

In one embodiment, a system is provided for controlling movement to of a marine vessel. An operator controllable device outputs a signal that is representative of an operator-desired rate of position change of the vessel about or along an axis. A sensor outputs a signal that is representative of a sensed rate of position change of the vessel about or along the axis. A rate of position change controller outputs a rate of position change command based upon the difference between the desired rate of position change and the sensed rate of position change. A vessel coordination controller controls movement of the vessel based upon the rate of position change command.

In a preferred embodiment, the system includes a operator controllable device that is a joystick and wherein movement of the joystick is a function of a operator-desired velocity about the yaw axis of the marine vessel. In this arrangement, zero movement of the joystick outputs a desired yaw change rate of zero.

In another embodiment, a method is provided for controlling movement of a marine vessel. A manually controllable device is operated to detect a operator-desired rate of position change of the vessel about or along an axis. An actual rate of position change of the vessel about or along the axis is sensed and a rate of position change command is outputted based upon the difference between the desired rated of position change and the sensed actual rate of position change. Movement of the vessel is controlled based upon the rate of position change command.

In a preferred embodiment, the method controls movement of the marine vessel about the yaw axis. A joystick is operated to output a proportional signal that is a function of the operator-desired velocity of the marine vessel about the yaw axis. The method further can include the step of outputting a desired yaw change rate of zero when there is zero movement of the joystick.

BRIEF DESCRIPTION OF THE DRAWINGS

The best mode of practicing the invention is described herein below, with reference to the following drawing figures.

DETAILED DESCRIPTION OF THE DRAWINGS

Figure 1:
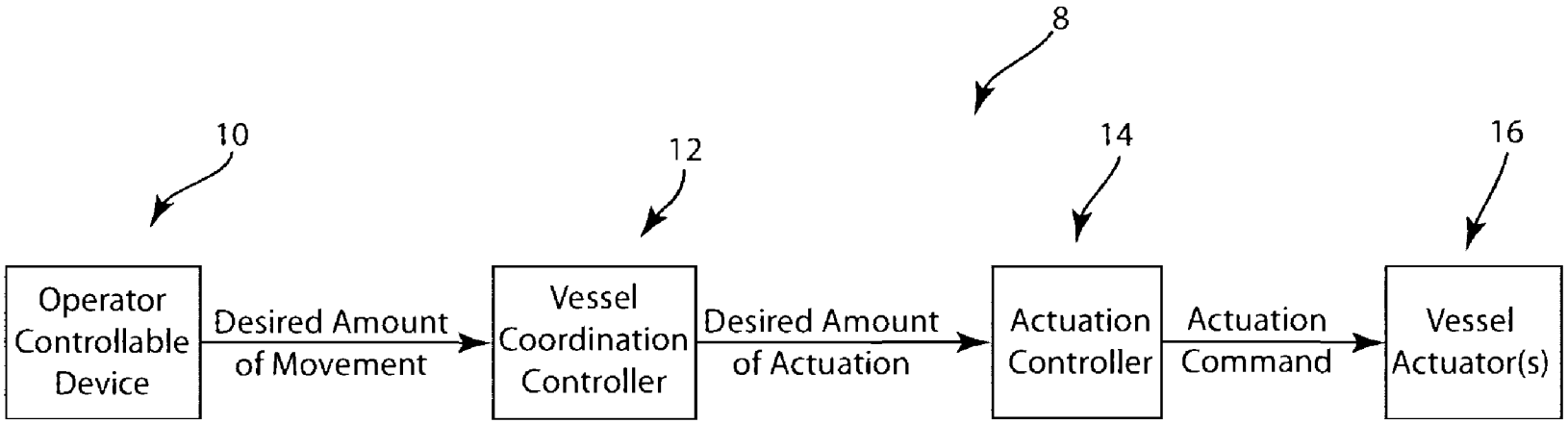
FIG. 1 PRIOR ART
FIG. 1 is a prior art control arrangement for a marine vessel.

FIG. 1 shows a basic prior art control system 8 for a marine vessel. Operator controllable device 10 is actuated by an operator to output a desired maneuvering activity to a marine vessel coordination controller 12. The desired maneuvering activity constitutes a desired amount of movement of the vessel, such as for example straight ahead, reverse, and/or rotate about the yaw axis of the vessel in a clockwise or counterclockwise direction. The coordination controller 12 receives commands from the controllable device 10 and calculates the appropriate actuation amount (e.g. amount of thrust) necessary for the vessel to achieve the desired maneuver. Based upon this calculation, an actuation controller 14 outputs an actuation command to vessel actuators 16, which typically include one or more propulsion units attached to the transom of the vessel. For example, the actuation controller 14 provides speed control commands and direction control commands for the propulsion unit(s) to achieve the desired maneuver.

Figure 2:
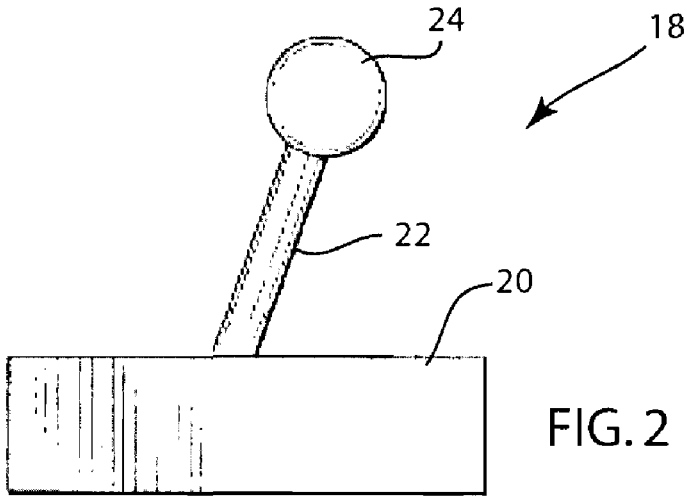
FIG. 2 is a joystick that is useful with the system of the present application.
Figure 3:
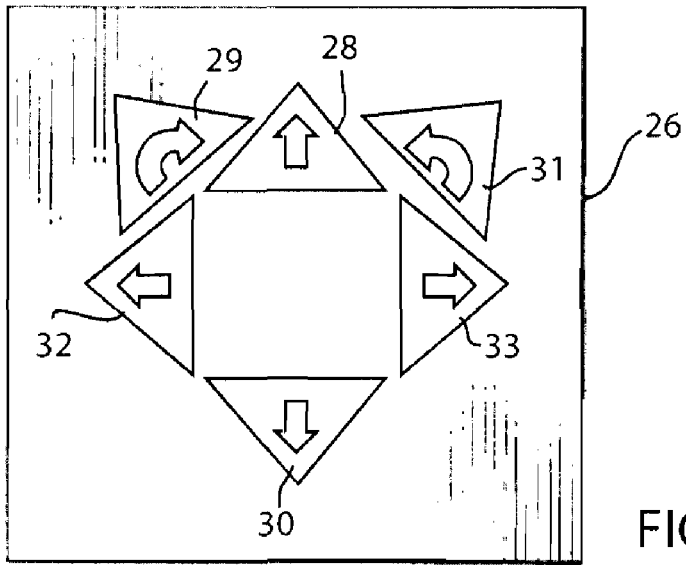
FIG. 3 is a control pad that is useful with the system of the present application.

The controllable device 10 can include any structure suitable for accomplishing the functions described above. FIGS. 2 and 3 show two possible types of manually controllable devices. FIG. 2 shows a well-known joystick device 18 that comprises a base 20, a stick or lever 22, and an end configuration 24 that is suitable for movement by an operator's hand. The stick 22 can be moved in a 360° rotation, and including left and right movement and backward relative to the base 20. The end configuration 24 can be twisted to input rotational movement commands for the vessel about the yaw axis. FIG. 3 shows an alternative configuration that provides a panel base 26 which has six push buttons or pads 28-33. A forward pad 28, a reverse pad 30, a left pad 32, and a right pad 33 can be incorporated to provide the desired vessel maneuvering activity. Similarly, a counterclockwise rotation pad 29 and a clockwise rotation pad 31 can be combined to provide the desired vessel maneuvering activity. Regardless of whether the joystick 18 or the plurality of push buttons 28-33 is used, the basic signals received by the coordination controller 12 typically reflect a desired movement command. With the joystick shown in FIG. 2, or the buttons shown in FIG. 3, an operator of a marine vessel can convey the desired movement command to the vessel coordination controller 12.

In the prior art system 8, the controllable device 10 outputs a proportional signal based on movement of the controllable device 10. The coordination controller 12 receives the proportional signal and interprets it as the amount or speed at which the operator wants the vessel to move, either forward, reverse, to the right, to the left, or to yaw (i.e. stay in place and turn to the right or left). Thus, active movement of the vessel about or along an axis (such as for example about its yaw axis) is a function of the proportional displacement of the controllable device 10. The coordination controller 12 directly interprets movement of the controllable device 10 and then commands the actuation controller 14 to move the actuators 16 by changing an amount of thrust outputted by the propulsion units.

During operation of the vessel, unintended movements are caused by external effects on the vessel, such as wind, current, etc., none of which are compensated for by the prior art system 8. Therefore, a serious disadvantage of the prior art system 8 is that the operator must compensate for these movements.

Figure 4:
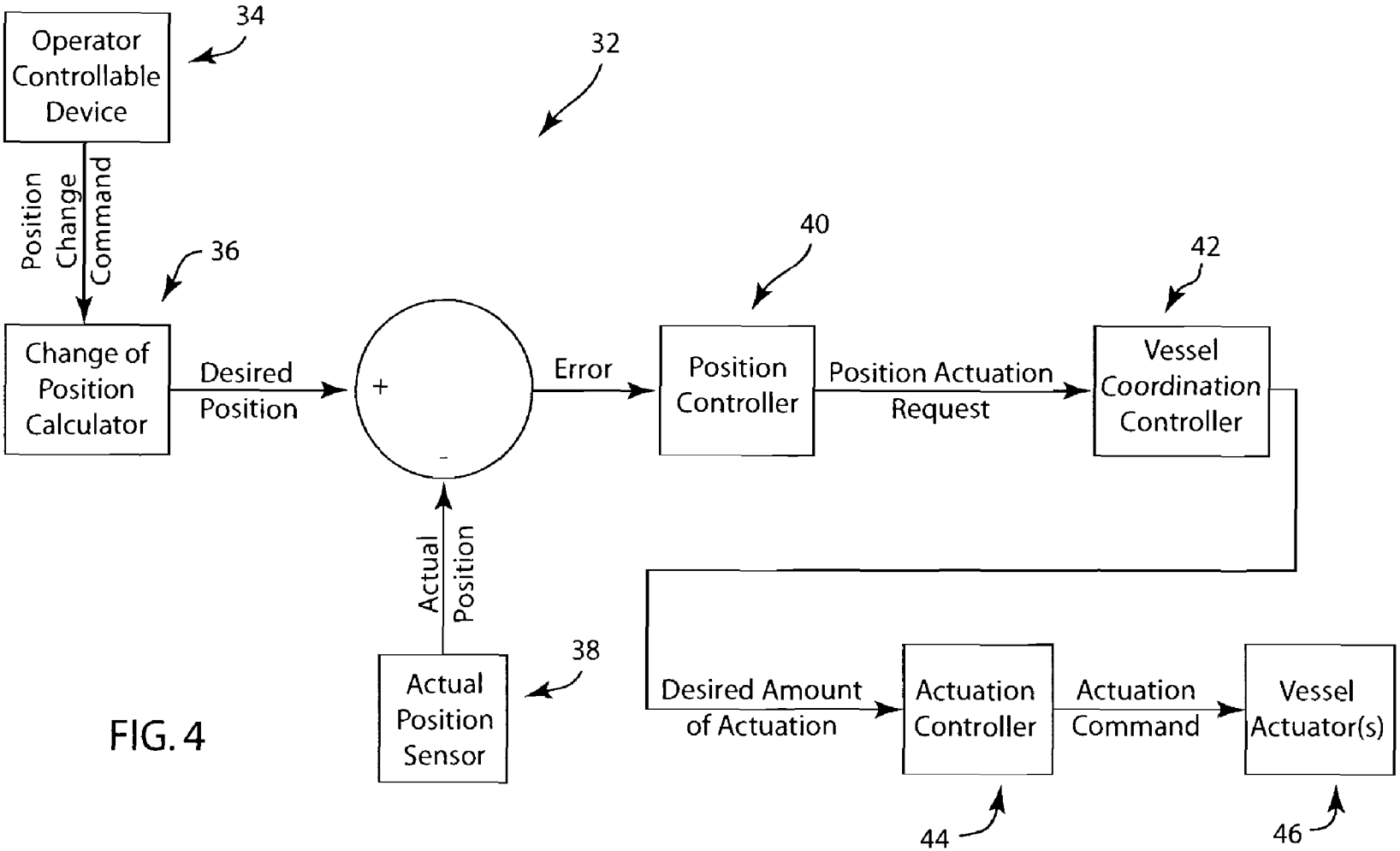
FIG. 4 is a control system for a marine vessel.

FIG. 4 schematically depicts a control system 32 that constitutes an attempt at improving the prior art system 8 of FIG. 1. The control system 32 is generally based upon feedback of desired and actual vessel position to a position controller. An operator controllable device 34, such as a joystick or control pad, is actuated by an operator to output a desired vessel maneuvering activity to a change of position of calculator 36. The desired maneuvering activity constitutes a position change command, which can represent a desired change of position of the vessel in a direction, such as for example straight ahead, reverse, and/or rotate about the yaw axis of the vessel in a clockwise or counterclockwise direction. The change of position calculator 36 receives the position change command and then calculates and outputs a desired position. The desired position is compared to an actual position outputted by actual position sensor 38. The difference or "error" between the desired position and actual position is input to position controller 40, which thereafter outputs a position actuation request to vessel coordination controller 42. The vessel coordination controller 42 uses the position actuation request to output a desired amount of actuation to actuation controller 44, which in turn outputs an actuation command to vessel actuators 46, which operate to achieve the desired maneuver.

A serious drawback of the prior art system 32 is the generation of undesirable amounts of rebound, e.g. overshoot or return of heading position, none of which is compensated for by the prior art system 32, and thus has to be compensated for by the operator. The prior art system 32 causes vessel movements that are not requested by, and not otherwise intuitive to the operator. For example, if an external force such as a gust of wind or a wave pushes the vessel off its operator intended heading, the prior art control system 32 calculates an error between the actual heading of the vessel and the desired heading of the vessel and then corrects the error by automatically repositioning the vessel back to its intended course. Therefore, the vessel moves even though the operator did not input any movement command via the controllable device 10. More typical of fully automatic pilots, these types of movements, uncommanded by the human operator, are not intuitive and in fact decrease the operator's feeling of command to and control over the movement of the vessel.

It is therefore highly desirable to provide a control system for a marine vessel and a method for controlling a marine vessel that allows the vessel to hold a constant heading when in translation forward, sideways, or diagonally unless specifically commanded to yaw. It is further desirable to accomplish this goal while minimizing uncommanded vessel movements and thus maximizing the operator's feeling of command and control over the movement of the vessel.

Figure 5:
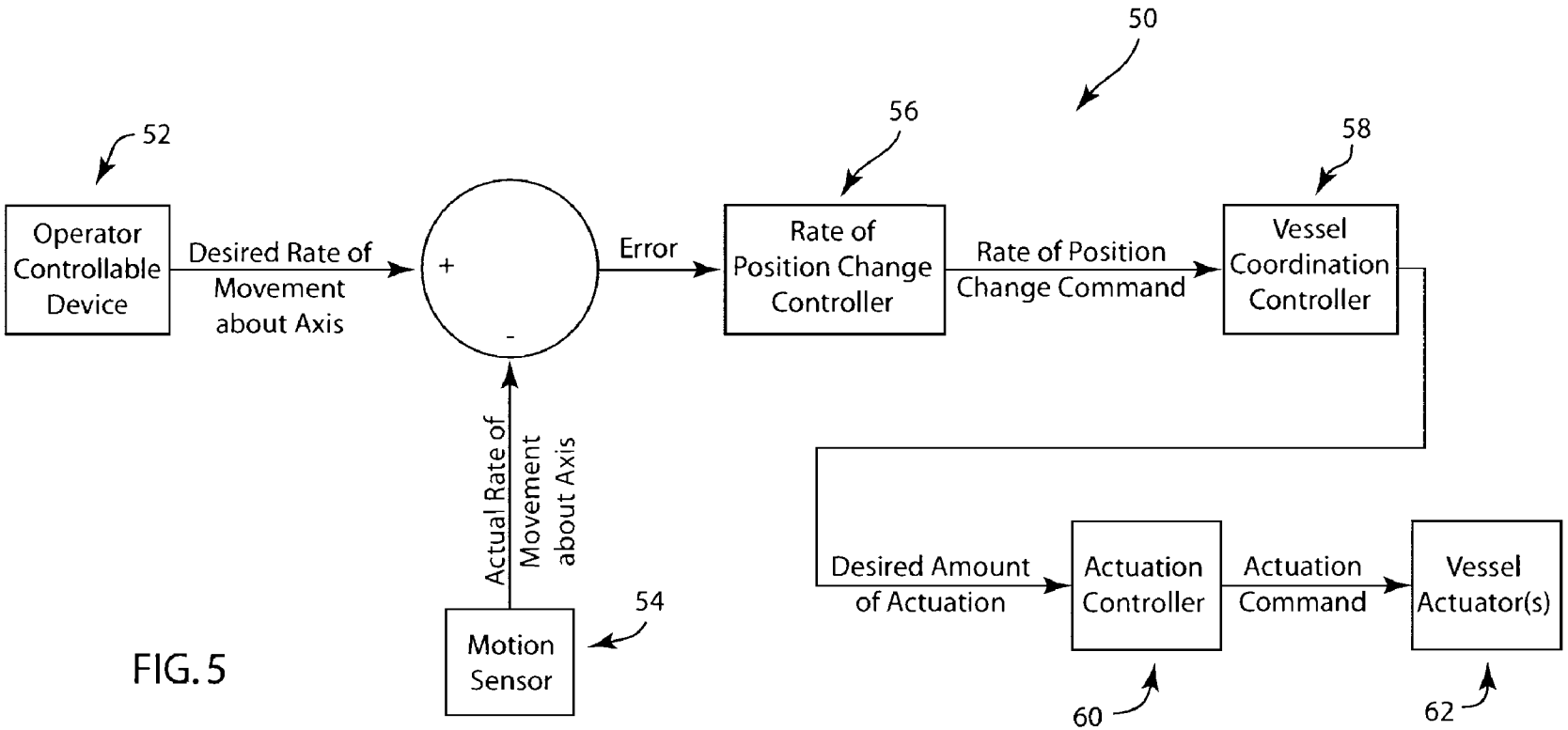
FIG. 5 is one embodiment of a control system for a marine vessel according to the present application.

As shown in FIG. 5, the present application provides such a system and method for controlling movement of a marine vessel, and particularly movement of the vessel about a directional axis of travel, such as for example the yaw axis.

Although the illustrated embodiment explains a system and method in terms of translation of a vessel about its yaw axis, it will be understood by those skilled in the art that the system and method described and claimed herein are useful for control of any type of motion or translation of the vessel, including but not limited to movement of a vessel about its roll and pitch axes and translation of the vessel in the fore, aft, left, right, up and down directions.

In its preferred and illustrated embodiment, the system 50 includes a operator controllable device 52 suitable for outputting an operator-desired rate of movement of a vessel about its yaw axis. The operator controllable device 52 can include any one of a wide variety of proportional-integral operator input devices known in the art, such as for example the joystick 18 or control panel 26 shown in FIGS. 2 and 3. The operator controllable device 52 is typically located inside the vessel and suitably positioned for operation by an operator of the vessel.

The system 50 further includes a motion sensor 54 coupled to the vessel and adapted to sense actual rate of movement of the vessel in real time. Preferably, motion sensor 54 comprises a yaw rate sensor that is capable of sensing and providing an indication of actual yaw rate of the vessel about its yaw axis. Yaw rate sensors, such as for example inertial motion unit sensors, are well-known and readily available in the art and as such are not further described herein.

The operator controllable device 52 and motion sensor 54 both operatively communicate with a rate of position change controller 56, which in the preferred embodiment is best described as a proportional-integral yaw rate controller. The controller 56 is programmed to output a rate of position change command based upon the difference between the desired rate of movement output (e.g. desired yaw rate) by the operator controllable device 52 and the actual rate of movement output (e.g. actual yaw rate) by the motion sensor 54. The outputted rate of position change command from the controller 56 is received by the vessel coordination controller 58, which, in turn, is programmed to output a desired amount of actuation (e.g. thrust) necessary to achieve the rate of position change commanded by the operator via the operator controllable device 52. An actuation controller 60 is, in turn, programmed to output an actuation command to vessel actuators 62 based upon the desired amount of activation outputted by the vessel coordination controller 58.

The system 50 of the present application advantageously provides the vessel operator with a significantly improved feel of control over the vessel by providing automatic yaw damping in line with manual translation and operator-originating yaw commands. The operator does not control the actuators directly, as in the prior art system 8. Rather, the operator uses the operator controllable device 52 to request a rate of change in heading from the rate of position change controller 56. Thus, when the operator controllable device 52 is not actuated (i.e. "zeroed"), the operator is in effect requesting a zero rate of change in movement or heading. That is, the rate of position change controller 56 interprets a lack of movement of the operator controllable device 52 as a request for active suppression of heading change (e.g. damping of yaw rate), rather than as a request for no actuation (e.g. continued movement in the unwanted direction). The system 50 thus actively damps unwanted motion of the vessel without causing new, uncommanded motions, such as the rebound that would occur with a return to a fixed heading, after a disturbance that changed heading.

In the preferred embodiment, the yaw rate coordination controller 12 provides outputs to the activation controller 14 that manage the rate of heading change, which nets out as the operator-desired heading position achieved. The results of the system and method shown and described herein are that the vessel has less unintended motion (e.g. yaw) in all active modes, thus making the control system 50 more intuitive to operate. This is especially true in pure translation, as all disturbances to direction of movement are automatically damped by the rate of position change controller 56 and do not require additional thought or input from the operator to null.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Various alternatives and embodiments are contemplated as being with in the scope of the following claims, particularly pointing out and distinctly claiming the subject matter regarded as the invention.

What is claimed is:

1. A system for controlling movement of a marine vessel, the system comprising:

a operator controllable device having an output that is representative of a operator-desired rate of position change of the vessel about or along an axis;

a sensor having an output that is representative of a sensed actual rate of position change of the vessel about or along the axis;

a rate of position change controller outputting a rate of position change command based upon the difference between the desired rate of position change and the sensed actual rate of position change; and a vessel coordination controller controlling movement of the vessel based upon the rate of position change command;

wherein the rate of position change controller is configured to interpret a lack of movement of the operator controllable device to be a request for active suppression of position change rather than as a request for no position change.

2. The system of claim 1, wherein the axis is the yaw axis and the desired rate of position change is the operator-desired yaw rate.

3. The system of claim 1, wherein the manually controllable device outputs a signal that is proportional to movement of a joystick.

4. The system of claim 3, wherein movement of the joystick is a function of operator-desired velocity about the yaw axis of the marine vessel.

5. The system of claim 3, wherein zero movement of the joystick outputs a desired yaw change rate of zero.

6. The system of claim 1, wherein the operator controllable device is a proportional integral controller.

7. The system of claim 1, wherein the sensor is an inertial motion unit.

8. The system of claim 1, comprising an actuator controller controlling actuators for driving the movement of the vessel based upon output from the vessel coordination controller.

9. A method for controlling movement of a marine vessel, the method comprising the steps of:

operating a manually controllable device to detect a operator-desired rate of position change of the vessel about or along an axis;

sensing an actual rate of position change of the vessel about or along the axis;

outputting a rate of position change command based upon the difference between the operator-desired rate of position change and the sensed actual rate of position change;

controlling movement of the vessel based upon the rate of position change command;

wherein the rate of position change controller is configured to interpret a lack of movement of the operator controllable device to be a request for active suppression of position change rather than as a request for no position change.

10. The method of claim 9, wherein the axis is the yaw axis and the operator-desired rate of position change is the operator-desired yaw rate.

11. The method of claim 9, wherein the manually controllable device is a joystick and comprising the step of outputting a signal that is proportional to movement of a joystick.

12. The method of claim 11, wherein movement of the joystick is a function of operator-desired velocity about the yaw axis of the marine vessel.

13. The method of claim 11, comprising the step of outputting a desired yaw change rate of zero when the joystick is not moved.

14. The method of claim 9, wherein the operator controllable device is a proportional integral controller.

15. The method of claim 9, wherein the actual rate of position change is sensed with an inertial motion unit.

16. The method of claim 9, comprising the steps of outputting an actuation control signal to an actuator controller and driving the movement of the marine vessel based upon the actuation control signal.

17. A system for controlling movement of a marine vessel about a yaw axis, the system comprising:

a joystick having an output that is representative of a desired yaw change rate;

a sensor having an output that is representative of a sensed actual yaw rate of the marine vessel;

a yaw rate controller outputting a yaw rate command based upon the difference between the desired yaw change rate and the sensed actual yaw rate;

a vessel coordination controller outputting an actuation command based upon the yaw rate command; and an actuator controlling movement of the marine vessel based upon the yaw rate command;

wherein the rate of position change controller is configured to interpret a lack of movement of the operator controllable device to be a request for active suppression of position change rather than as a request for no position change.

* * * * *